US008166938B2

(12) United States Patent
Bittner et al.

(10) Patent No.: US 8,166,938 B2
(45) Date of Patent: May 1, 2012

(54) ENGINE CAMSHAFT COVER WITH INTEGRATED OIL PASSAGES FOR CAMSHAFT PHASER ACTUATION

(75) Inventors: Roxann M. Bittner, Bloomfield Hills, MI (US); Norman Peralta, Northville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 12/964,320

(22) Filed: Dec. 9, 2010

(65) Prior Publication Data

US 2011/0277722 A1 Nov. 17, 2011

Related U.S. Application Data

(60) Provisional application No. 61/345,375, filed on May 17, 2010.

(51) Int. Cl.
*F01M 1/06* (2006.01)

(52) U.S. Cl. ..... 123/90.33; 123/90.16; 123/195 C

(58) Field of Classification Search ..... 123/90.38, 123/90.16, 90.17, 195 C, 90.33, 90.15, 90.31
See application file for complete search history.

(56) References Cited

U.S. PATENT DOCUMENTS

| | | | | |
|---|---|---|---|---|
| 7,341,033 | B2 * | 3/2008 | Yoshijima et al. | 123/90.38 |
| 7,669,565 | B2 | 3/2010 | Pass | |
| 2003/0089328 | A1 * | 5/2003 | McGloin | 123/193.5 |
| 2006/0112916 | A1 * | 6/2006 | Yoshijima et al. | 123/90.15 |

* cited by examiner

*Primary Examiner* — Zelalem Eshete
(74) *Attorney, Agent, or Firm* — Quinn Law Group, PLLC

(57) ABSTRACT

A camshaft cover mounts to a cylinder head and defines cavities for oil control valves that adjust the position of camshafts via camshaft phaser assemblies. The cavities are positioned above the camshafts when the camshaft cover is mounted to the cylinder head. A feed passage communicates pressurized fluid from the cylinder head to the cavities when the camshaft cover is mounted to the cylinder head. Control passages communicate fluid from the cavities to the camshaft phaser assemblies when the camshaft cover is mounted to the cylinder head.

14 Claims, 4 Drawing Sheets

ENGINE CAMSHAFT COVER WITH INTEGRATED OIL PASSAGES FOR CAMSHAFT PHASER ACTUATION

CROSS-REFERENCE TO RELATED APPLICATIONS

This application claims the benefit of U.S. Provisional Patent Application No. 61/345,375, filed May 17, 2010, and which is hereby incorporated by reference in its entirety.

TECHNICAL FIELD

The invention relates to a camshaft cover for an engine that has hydraulically-actuated camshaft phasers.

BACKGROUND

Consumer demand for fuel efficient and relatively low content vehicles has created a need for new engine assemblies. Sophisticated engine subsystems, such as camshaft phaser assemblies and fuel injection systems, increase the number and complexity of engine components that must be packaged in a relatively small space.

SUMMARY

An engine is provided with a camshaft cover that has integrated oil passages positioned to permit cam phasing using "off the shelf" hydraulic control valves without extending the axial length of the engine. The camshaft cover may be configured for a central injection-type engine, although it is not limited to this type of engine.

Specifically, a camshaft cover mounts to a cylinder head and defines cavities for oil control valves that control camshaft phaser assemblies of overhead camshafts. The cavities are positioned above the camshafts when the camshaft cover is mounted to the cylinder head. The camshaft cover has a feed passage that communicates pressurized fluid from the cylinder head to the cavities when the camshaft cover is mounted to the cylinder head. The camshaft cover also has control passages that communicate fluid from the cavities to the camshaft phaser assemblies when the camshaft cover is mounted to the cylinder head.

The above features and advantages and other features and advantages of the present invention are readily apparent from the following detailed description of the best modes for carrying out the invention when taken in connection with the accompanying drawings.

DETAILED DESCRIPTION

Figure 1:
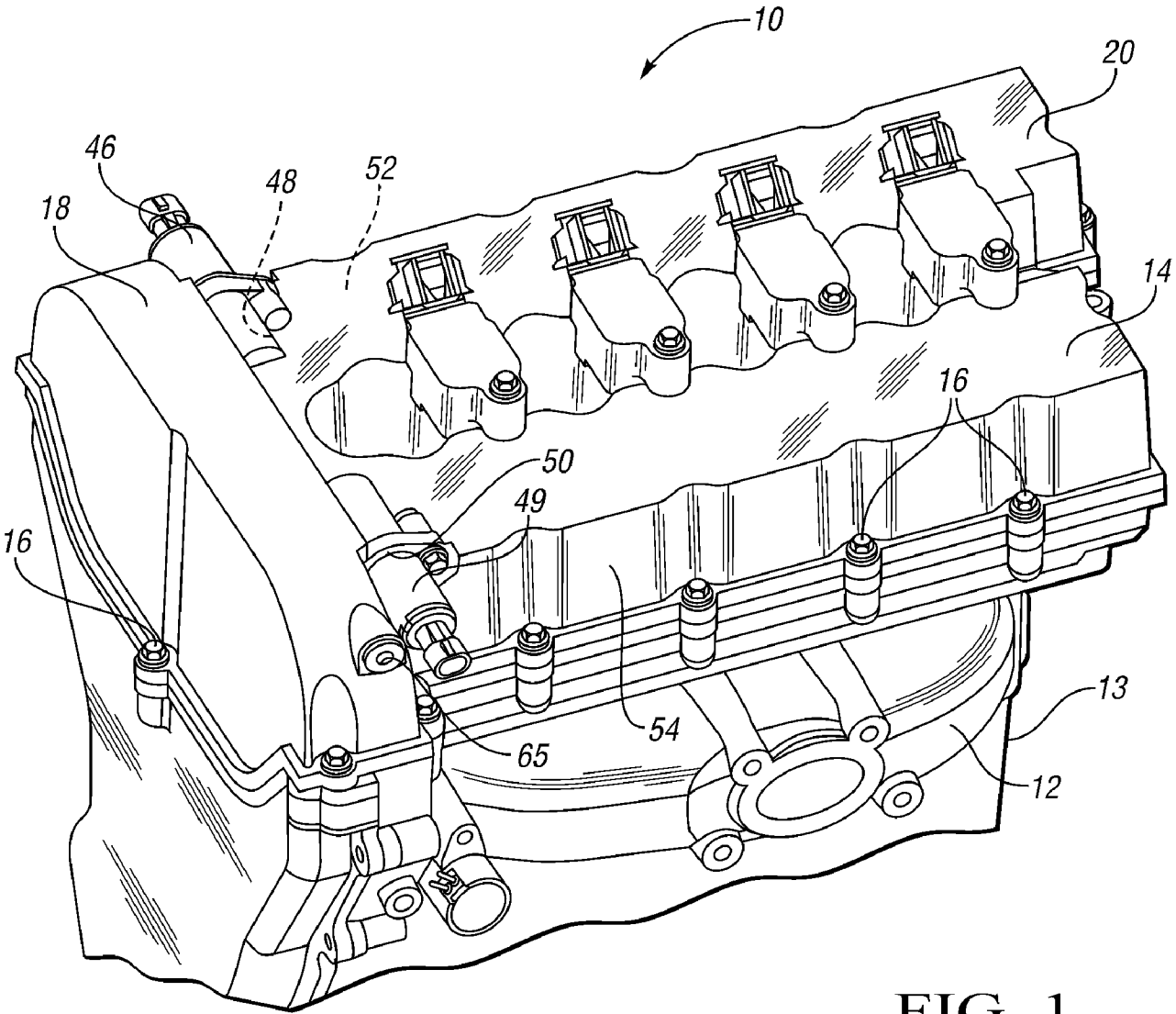
FIG. 1 is a schematic perspective illustration of an engine in fragmentary view showing a camshaft cover secured to a cylinder head.

Referring to the drawings, wherein like reference numbers refer to like components, FIG. 1 shows an engine 10. The engine 10 has an engine cylinder head 12 secured to an engine block 13 that supports a crankshaft driven by pistons in the engine block. The cylinder head 12 supports engine valves and has inlet and exhaust ports that facilitate combustion and exhaust from cylinders in the engine block 13. A camshaft cover 14 is secured to the cylinder head 12 with fasteners 16. The camshaft cover 14 may be one or more pieces, and is shown here as a single piece with a front cover portion 18 and a main portion 20. The camshaft cover 14 may be aluminum or another material that may be cast or formed relatively easily with the cavities, openings and passages described herein.

Figure 2:
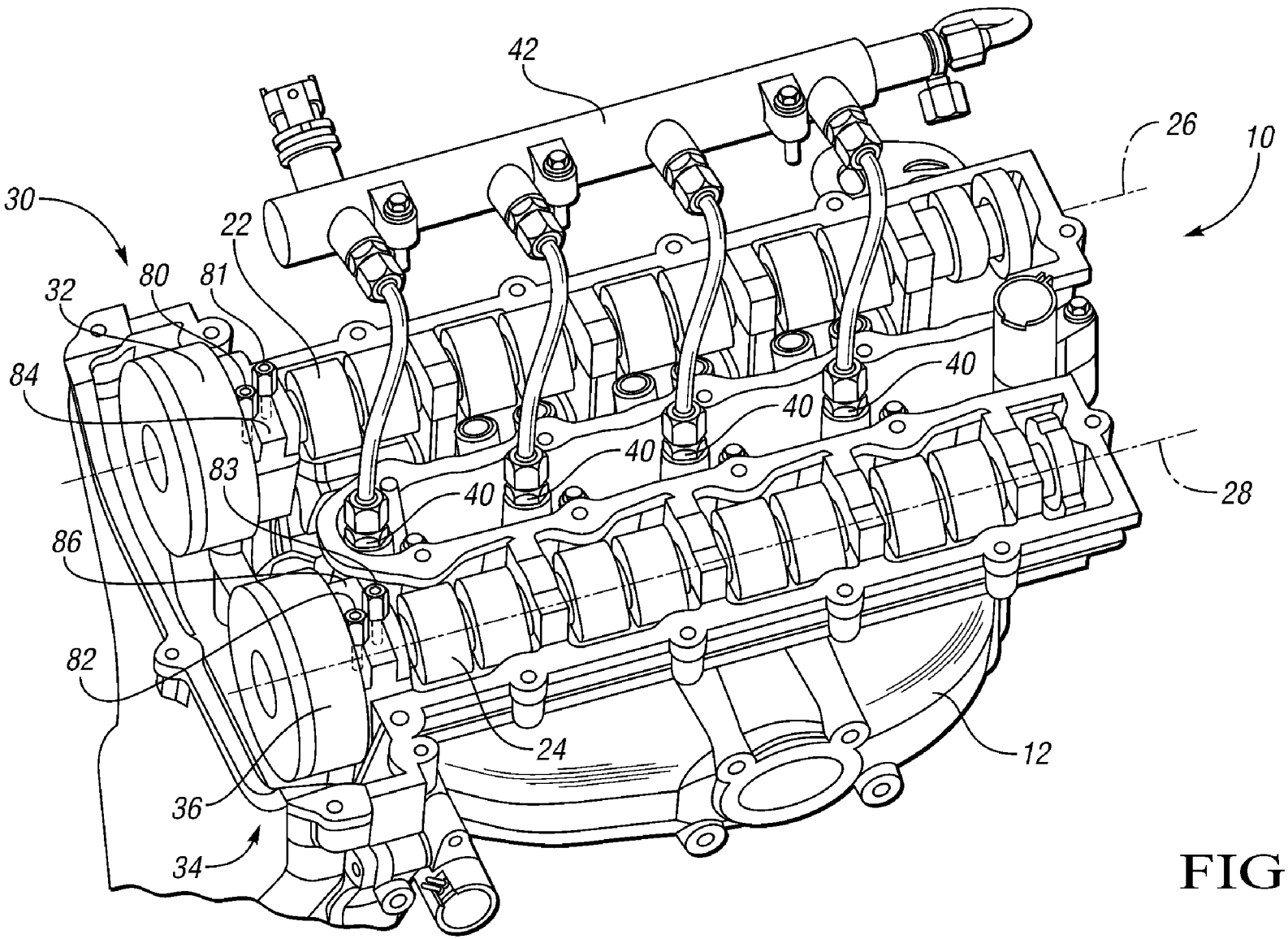
FIG. 2 is a schematic perspective illustration in fragmentary view of the engine of FIG. 1 with the camshaft cover removed.

As shown in FIG. 2, the camshaft cover 14 covers first and second camshafts 22, 24 that are visible when the camshaft cover 14 is removed. The first camshaft 22 rotates about an axis of rotation 26 and the second camshaft 24 rotates about an axis of rotation 28 parallel with the axis of rotation 26. The camshafts 22, 24 have eccentric lobes that are operable to open and close intake and exhaust valves (not shown). The camshafts 22, 24 are driven by the crankshaft via a timing chain (not shown) at a predetermined speed of rotation relative to the speed of rotation of the crankshaft.

A first hydraulically-actuated cam phaser assembly 30 is connected to an end of the first camshaft 22 and has a first cam phaser 32. A second hydraulically-actuated cam phaser assembly 34 is connected to an end of the second camshaft 24 and has a second cam phaser 36. The cam phaser assemblies 30, 34 are operable to vary the angular orientation of the camshafts 22, 24 relative to the crankshaft, based on engine operating conditions, to change the timing of the lifting and lowering of engine valves.

Control of the cam phaser assemblies 30, 34 requires oil control valves, such as electronically-actuated solenoid valves, as well as fluid passages to the control valves, and from the control valves to the cam phaser assemblies 30, 34. Referring to FIG. 2, it is apparent that the engine 10 is a central injection engine, having fuel injectors 40 mounted to the cylinder head 12, positioned between the camshafts 22, 24, and fed by a fuel rail 42. The compact axial length of the engine 10 combined with the centrally-located fuel injectors 40 results in insufficient packaging space to mount oil control valves to the cylinder head 12. The cylinder head 12 has a relatively complex shape that makes it difficult to route fluid passages necessary to direct fluid from a source of pressurized fluid to oil control valves and on to the cam phasers 32 and 36. Furthermore, fluid passages cannot be formed to route fluid from the first camshaft 22 to the second camshaft 24 transversely in the cylinder head 12 due to the centrally-mounted fuel injectors 40. In part due to these packaging limitations, many engines are generally not equipped with cam phasing technology.

To overcome these barriers, the camshaft cover 14 is configured to support first and second oil control valves 46, 49 as shown in FIG. 1 above the camshafts 22, 24 of FIG. 2, and also to provide fluid passages to allow fluid actuation of the first and second phasers 32, 36. As shown in FIG. 1, a first oil control valve 46 is mounted in a cavity 48 formed by the camshaft cover 14. A second oil control valve 49 is mounted in a cavity 50 formed by the camshaft cover 14. The cavities 48, 50 are formed at opposing sides 52, 54 of the camshaft cover 14 and are oriented so that center axes through the cavities 48, 50 are not parallel to the axes of rotation 26, 28 of the camshafts 22, 24 shown in phantom in FIG. 2. For example, the cavities 48, 50 may extend perpendicularly to the axes of rotation 26, 28 of the camshafts 22, 24, or at some other angle with respect to the axes of rotation 26, 28 of the camshafts 22, 24. The control valves 46, 49 are positioned in the cavities 48, 50, respectively, to mount to the camshaft cover 14, extending partially out of the camshaft cover 14 and in a position not parallel to the axes of rotation 26, 28 of the camshafts 22, 24, so that the axial length of the engine 10 need not be increased in order to accommodate the oil control valves 46, 49.

Figure 4:
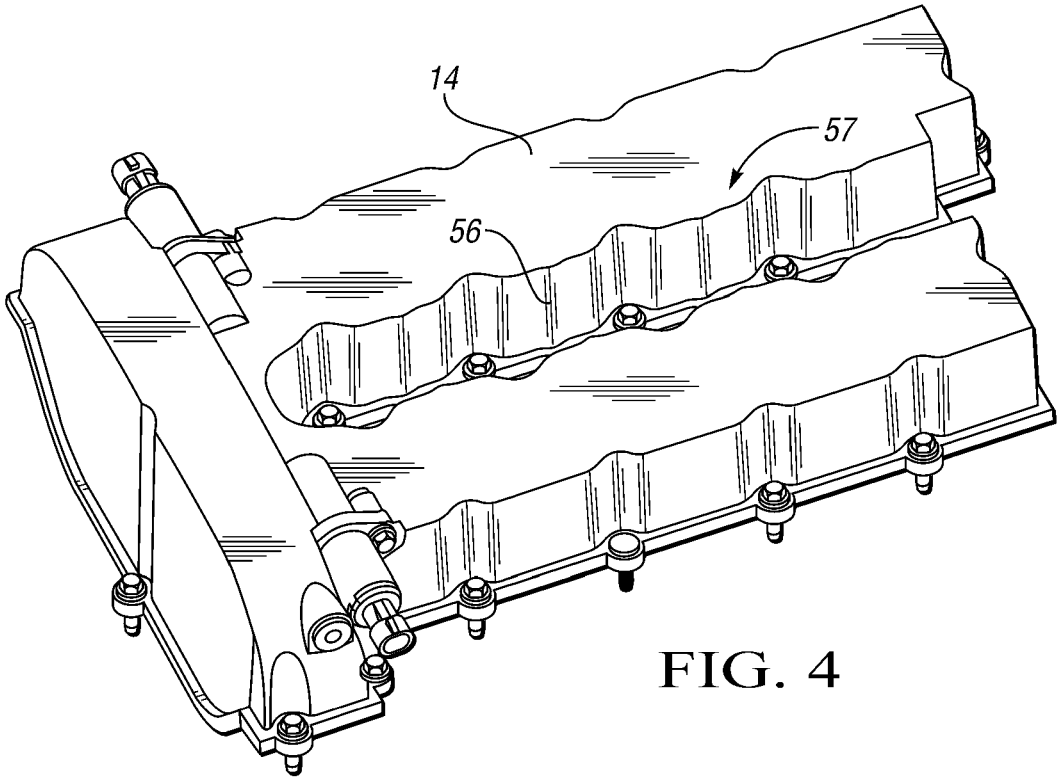
FIG. 4 is a schematic perspective illustration of the camshaft cover with oil control valves mounted to the cover.

In FIG. 4, a central opening 56 is formed by the camshaft cover 14 and extends through an upper surface 57 of the camshaft cover 14. The central opening 56 allows the fuel injectors 40 to be centrally-mounted to the cylinder head 12 as shown in FIG. 2 through the central opening 56 when the camshaft cover 14 is mounted to the cylinder head 12.

Figure 3:
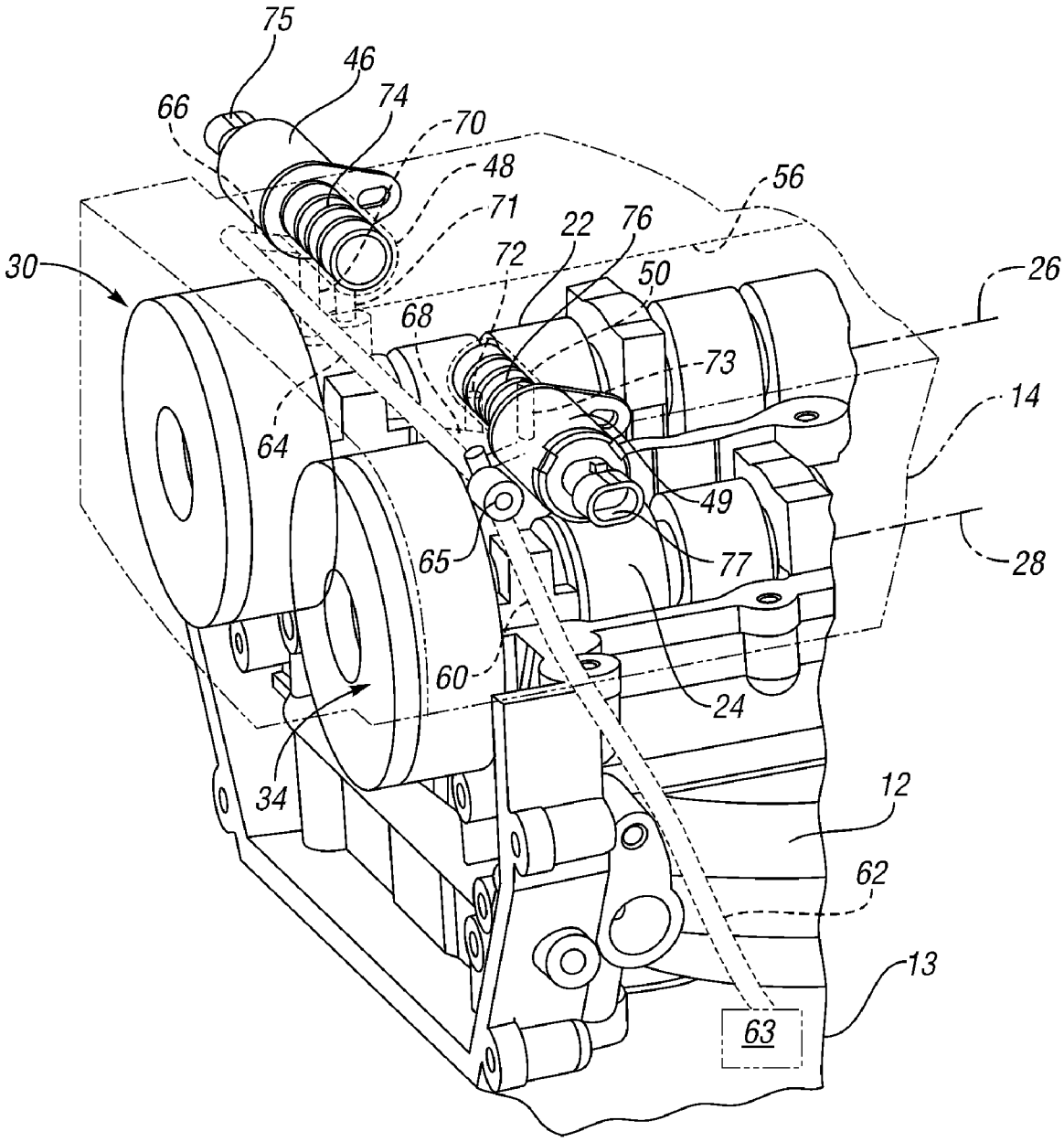
FIG. 3 is a schematic perspective illustration in fragmentary view of a portion of the engine of FIGS. 1 and 2, with the camshaft cover shown in phantom.

Referring to FIG. 3, the position of the first and second oil control valves 46, 49 relative to the first and second camshafts 22, 24, the first and second camshaft phaser assemblies 30, 34 and the cylinder head 12 is shown by representing the camshaft cover 14 in phantom. Specifically, the oil control valves 46, 49 are positioned above the camshafts 22, 24 and between the central opening 56 and the first and second cam phaser assemblies 30, 34.

The camshaft cover 14 also enables the routing of pressurized fluid to control the cam phasers 32, 36 of FIG. 2. As shown in FIG. 3, a feed passage 60 formed in the camshaft cover 14 interfaces with a feed passage 62 formed in the cylinder head 12. Feed passage 62 is in fluid communication with a source of pressurized fluid, pump 63 located in the engine block 13. A transverse feed passage 64 intersects the feed passage 60 to distribute pressurized fluid to both of the oil control valves 46, 49 via relatively short branch passages 66, 68. A plug 65 closes the end of transverse feed passage 64. The camshaft cover 14 forms a first control passage 70 slightly offset from the branch passage 66 and a second control passage 72 slightly offset from the branch passage 68. The camshaft cover 14 also forms a third control passage 71 and a fourth control passage 73 slightly offset from the respective branch passages 66, 68. Control passages 70, 72 are used to advance the position of the camshafts 22, 24 relative to the engine crankshaft, while control passages 71, 73 are used to retard the position of the camshafts 22, 24 relative to the engine crankshaft. The feed passage 64 and branch passage 66 are only in communication with the control passage 70 through the interface of valve body 74 of the oil control valve 46 with the cavity 48, which depends on the electronically-controlled position of the valve body 74.

Similarly, feed passage 64 and branch passage 68 are only in communication with the control passage 72 through the interface of valve body 76 of the oil control valve 49 with the cavity 50, which depends on the electronically-controlled position of the valve body 76. FIG. 3 shows electrical connectors 75, 77 that connect to a controller (not shown) to receive electronic control signals that control movement of the valve bodies 74, 76. Drain passages (not shown) are also formed by the camshaft cover 14 and intersect with the cavities 48, 50.

Figure 5:
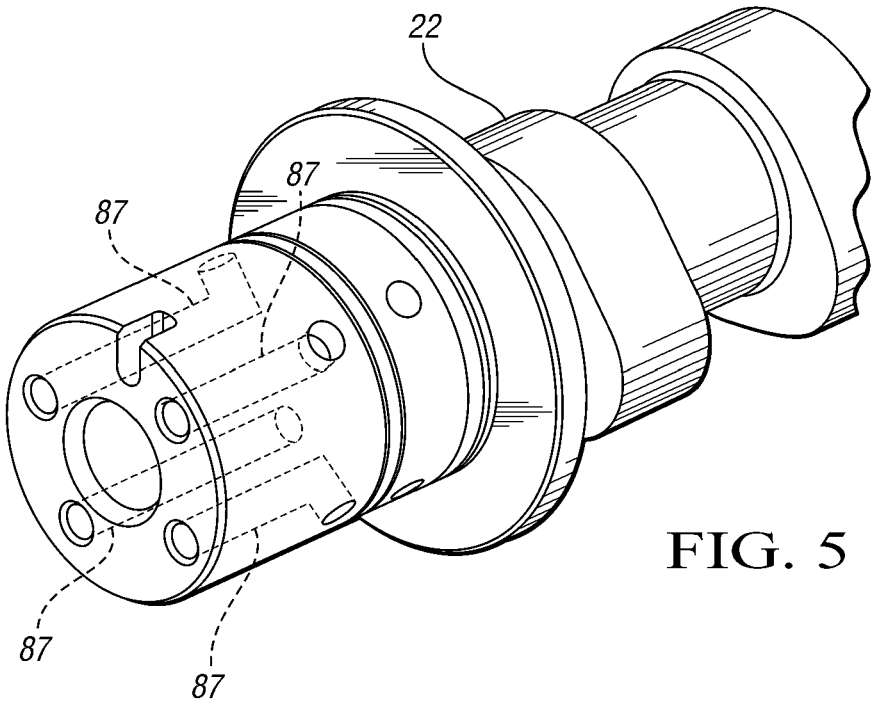
FIG. 5 is a schematic perspective illustration in fragmentary view of one of the camshafts of FIGS. 2 and 3.

The control passages 70, 72 of FIG. 3 communicate with passages 80, 82 in first and second camshaft caps 84, 86, respectively, best shown in FIG. 2. Although two camshaft caps 84, 86 are used in this embodiment, a single camshaft cap may extend over both camshafts 22, 24. The control passages 71, 73 communicate with passages 81, 83 in the first and second camshaft caps 84, 86, respectively. The camshaft caps 84, 86 distribute the fluid from passages 81, 83 to the camshaft phasers 32, 36 through cavities 87 in the camshafts 22, 24. Cavities 87 are shown only in camshaft 22 in FIG. 5. Camshaft 24 has similar cavities. The control passages 80, 82 also communicate with the phasers 32, 36 above the camshafts 22, 24. The length of the control passages 70, 71, 72, 73, the length of flow passages 80, 81, 82, 83 through the camshaft caps 84, 86, and flow passages 87 through the camshafts 22, 24 (or flow directly from passages 81, 83) to the phasers 32, 36 are all relatively short, resulting in quick response time of the phasers 32, 36 to a control signal to the oil control valves 46, 49 commanding an adjustment.

Accordingly, the camshaft cover 14 enables the packaging of oil control valves 46, 49 and the routing of feed passages 60, 64 and branch passages 66, 68 without requiring a more expensive retooling of the cylinder head 12 to accommodate these features, and without extending the axial length of the central injection-type engine 10.

While the best modes for carrying out the invention have been described in detail, those familiar with the art to which this invention relates will recognize various alternative designs and embodiments for practicing the invention within the scope of the appended claims.

The invention claimed is:

1. An engine comprising:

an engine cylinder head;

first and second camshafts mounted to the engine cylinder head and rotatable about axes of rotation extending in a longitudinal direction;

first and second hydraulically-actuated camshaft phaser assemblies mounted to the first and second camshafts, respectively;

a camshaft cover at least partially covering the first and second camshafts and the first and second hydraulically-actuated camshaft phaser assemblies and connected to the cylinder head;

first and second oil control valves mounted to the camshaft cover and operable to control the first and the second camshaft phaser assemblies, respectively; wherein the camshaft cover defines a feed passage in communication with the first and second oil control valves and with the cylinder head and that directs pressurized fluid from the cylinder head to the first and second oil control valves for control of the first and second hydraulically-actuated camshaft phaser assemblies; and wherein the feed passage is in communication with the cylinder head laterally outward of the camshafts in a transverse direction substantially nonparallel to the longitudinal direction of the axes of rotation of the camshafts.

2. The engine of claim 1, further comprising fuel injectors mounted to the cylinder head between the first and second camshafts.

3. The engine of claim 1, wherein the camshaft cover is aluminum.

4. The engine of claim 1, wherein the camshaft cover defines a first cavity configured to partially house the first oil control valve and a second cavity configured to partially house the second oil control valve; wherein the first and second cavities extend substantially parallel to the feed passage; and wherein the first and second oil control valves extend partially out of the camshaft cover.

5. The engine of claim 4, wherein the first and second oil control valves extend substantially in the transverse direction.

6. The engine of claim 1, wherein the camshaft cover further defines a first control passage in fluid communication with the first oil control valve and with the first camshaft phaser assembly; and a second control passage in fluid communication with the second oil control valve and with the second camshaft phaser assembly.

7. The engine of claim 6, wherein the first and second hydraulically-actuated camshaft phaser assemblies include at least one phaser camshaft cap that defines passages in fluid communication with the first control passage and the second control passage, respectively.

8. The engine of claim 7, wherein the first and second camshafts define additional cavities in fluid communication with the passages in the at least one phaser camshaft cap and with the camshaft phaser assemblies.

9. A camshaft cover for a cylinder head of an engine having overhead camshafts rotatable about axes of rotation extending in a longitudinal direction and camshaft phaser assemblies controlled by oil control valves for adjusting the positions of the camshafts, wherein the camshaft cover mounts to the cylinder head and defines:

cavities for the oil control valves, wherein the cavities are positioned above the camshafts when the camshaft cover is mounted to the cylinder head;

a feed passage that communicates pressurized fluid from the cylinder head to the cavities when the camshaft cover is mounted to the cylinder head; wherein the cavities extend substantially parallel to the feed passage; wherein the feed passage extends from the cylinder head through the camshaft cover laterally outward of the camshafts in a transverse direction substantially nonparallel to the longitudinal direction of the axes of rotation of the camshafts; and control passages that communicate fluid from the cavities to the camshaft phaser assemblies when the camshaft cover is mounted to the cylinder head.

10. The camshaft cover of claim 9, wherein the camshaft cover is aluminum.

11. The camshaft cover of claim 9, wherein the cavities open at sides of the camshaft cover; and wherein the camshaft cover further defines a central opening extending through a surface of the camshaft cover between the sides.

12. The camshaft cover of claim 11, wherein the cavities are axially between the feed passage and the central opening.

13. The camshaft cover of claim 11 in combination with the engine including the cylinder head, the overhead camshafts, the camshaft phaser assemblies and the oil control valves; and wherein the engine is a central injection engine having fuel injectors extending through the central opening of the camshaft cover between the camshafts.

14. An engine comprising:

a cylinder head;

overhead camshafts supported by the cylinder head and rotatable about axes of rotation;

hydraulically-actuated camshaft phaser assemblies operable to adjust the position of the overhead camshafts;

oil control valves operable to control hydraulic fluid flow to the camshaft phaser assemblies;

fuel injectors;

a camshaft cover mounted to the cylinder head and defining:

cavities for the oil control valves;

a feed passage configured to communicate pressurized fluid from the cylinder head to the cavities;

control passages configured to communicate fluid from the cavities to the hydraulically-actuated camshaft phaser assemblies;

wherein the cavities open at sides of the camshaft cover; wherein the camshaft cover further defines a central opening extending through a surface of the camshaft cover between the sides with the fuel injectors mounted to the cylinder head through the central opening; and wherein the cavities and the feed passage are above the camshafts with the feed passage entirely axially outward of both the oil control valves and the cavities and axially between the hydraulically-actuated camshaft phaser assemblies and the cavities.

* * * * *